US010890426B2

(12) United States Patent
Labuschagne et al.

(10) Patent No.: US 10,890,426 B2
(45) **Date of Patent: *Jan. 12, 2021**

(54) DETONATOR

(71) Applicant: DETNET SOUTH AFRICA (PTY) LTD, Sandton (ZA)

(72) Inventors: Albertus Abraham Labuschagne, Brakpan (ZA); Andre Louis Koekemoer, Boksburg (ZA); Christopher Malcolm Birkin, Centurion (ZA); Craig Charles Schlenter, Johannesburg (ZA); Elmar Lennox Muller, Eldooraigne Centurion (ZA)

(73) Assignee: DETNET SOUTH AFRICA (PTY) LTD, Sandton (ZA)

( * ) Notice: Subject to any disclaimer, the term of this patent is extended or adjusted under 35 U.S.C. 154(b) by 102 days.

This patent is subject to a terminal disclaimer.

(21) Appl. No.: 16/286,954

(22) Filed: Feb. 27, 2019

(65) Prior Publication Data

US 2019/0195605 A1 Jun. 27, 2019

Related U.S. Application Data

(60) Division of application No. 15/441,470, filed on Feb. 24, 2017, now Pat. No. 10,527,395, which is a (Continued)

(30) Foreign Application Priority Data

Jul. 12, 2010 (ZA) ..... 2010/04911
Jan. 19, 2017 (ZA) ..... 2017/00446

(51) Int. Cl.
*F42D 1/05* (2006.01)
*F42D 1/04* (2006.01)
(Continued)

(52) U.S. Cl.
CPC ..... *F42D 1/042* (2013.01); *F42B 3/121* (2013.01); *F42C 11/06* (2013.01); *F42D 1/043* (2013.01);
(Continued)

(58) Field of Classification Search
CPC ..... F42D 1/042
(Continued)

(56) References Cited

U.S. PATENT DOCUMENTS 4,632,032 A 12/1986 Muller
5,101,727 A 4/1992 Yarrington
(Continued)

FOREIGN PATENT DOCUMENTS

CL 4992010 8/2010
DE 4427296 A1 2/1996
WO 9415169 A1 7/1994

OTHER PUBLICATIONS

English specification of South African Patent Application No. 95/6449, filed Aug. 2, 1995, published May 29, 1996, corresponding to German Patent Publication No. 44 27 296 A1.

*Primary Examiner* — Reginald S Tillman, Jr.
(74) *Attorney, Agent, or Firm* — Cantor Colburn LLP

(57) ABSTRACT

A detonator for use in a detonating system, which detonator includes discriminating and validating arrangements which sense and validate at least one characteristic of at least one parameter produced by at least one of a light, acoustic, vibratory, magnetic or electrical signal event, and an electronic timer which executes a timing interval in response thereto.

5 Claims, 5 Drawing Sheets

Related U.S. Application Data continuation-in-part of application No. 14/564,306, filed on Dec. 9, 2014, now Pat. No. 9,625,244, which is a division of application No. 13/179,652, filed on Jul. 11, 2011, now Pat. No. 8,967,048.

(51) Int. Cl.

| | |
|---|---|
| ***F42B 3/12*** | (2006.01) |
| ***F42C 11/06*** | (2006.01) |
| ***G04F 10/00*** | (2006.01) |
| ***G04F 3/08*** | (2006.01) |
| ***F42D 5/00*** | (2006.01) |

(52) U.S. Cl.

CPC ..... *F42D 1/05* (2013.01); *F42D 5/00* (2013.01); *G04F 3/08* (2013.01); *G04F 10/00* (2013.01)

(58) Field of Classification Search

USPC ..... 102/206, 215

See application file for complete search history.

(56) References Cited

U.S. PATENT DOCUMENTS

| | | | | |
|---|---|---|---|---|
| 5,133,257 | A | 7/1992 | Jonsson | |
| 5,173,569 | A | 12/1992 | Pallanck et al. | |
| 5,435,248 | A | 7/1995 | Rode et al. | |
| 5,929,368 | A | 7/1999 | Ewick et al. | |
| 5,942,718 | A | 8/1999 | Falquete et al. | |
| 7,624,681 | B2 | 12/2009 | Goodman et al. | |
| 8,857,339 | B2 | 10/2014 | Muller et al. | |
| 10,527,395 | B2 * | 1/2020 | Labuschagne ..... | F42C 11/06 |
| 2006/0249045 | A1 | 11/2006 | Goodman et al. | |
| 2008/0098921 | A1 | 5/2008 | Labuschagne et al. | |
| 2011/0155012 | A1 | 6/2011 | Perez Cordova et al. | |
| 2013/0180422 | A1 | 7/2013 | Liebenberg | |

* cited by examiner

DETONATOR

CROSS-REFERENCE TO RELATED APPLICATIONS

This application is a divisional application of continuation-in-part application Ser. No. 15/441,470, filed on 24 Feb. 2017 for "Detonator" which is a continuation-in-part application of patent application Ser. No. 14/564,306, filed on Dec. 9, 2014, for "Detonator Including a Sensing Arrangement", now U.S. Pat. No. 9,625,244, issued on Apr. 18, 2017, which is a divisional application of patent application Ser. No. 13/179,652, filed on Jul. 11, 2011, for "Timing Module", now U.S. Pat. No. 8,967,048, issued on Mar. 3, 2015, which claims the benefit of priority of South African Provisional Patent Application No. 2010/04911, filed Jul. 12, 2010. The continuation-in-part application (Ser. No. 15/441,470) and this divisional application each claims priority of the foregoing applications and of South African Provisional Patent Application No. 2017/00446, filed on Jan. 19, 2017.

BACKGROUND OF THE INVENTION

Field of the Invention

This invention relates to a detonator and is particularly concerned with an improvement to, or a development or modification of, the detonator described or claimed in the specification of U.S. Pat. No. 8,967,048 ("the parent patent").

Related Art

The specification of the parent patent describes a detonator which includes a sensing arrangement which senses at least one characteristic of at least one parameter generated by a shock tube event, a timer which is operable to complete execution of a timing interval of a predetermined duration in response to the sensing arrangement, a first energy source, an initiating element, a second energy source, a power management circuit which transfers electrical energy, derived from the second energy source, a power management circuit which transfers electrical energy, derived from the second energy source, into the first energy source at a voltage which is higher than a voltage which is available from the second energy source, and a switching arrangement which, in response to a timing signal produced at an end of the timing interval, is operable to connect the first energy source to the initiating element thereby to cause firing of the initiating element.

The specification of the parent patent also describes a detonator which includes a sensing arrangement which senses at least one characteristic of at least one parameter generated by a shock tube event, a timer which is operable to complete execution of a timing interval of a predetermined duration in response to the sensing arrangement, a first energy source, an initiating element, a switching arrangement which, in response to a timing signal produced by the timer, is operable to connect the energy source to the initiating element thereby to cause firing of the initiating element, and a circuit which discharges energy from the energy source if the timing signal is not produced by the timer.

An object of the present invention is to provide a detonator which exhibits most of the aforementioned characteristics but which is not dependent on the functioning of a shock tube event.

SUMMARY OF THE INVENTION

The present invention provides a detonator which includes a sensing arrangement, a timer which is operable to complete execution of a timing interval of a predetermined duration in response to the sensing arrangement, an energy source, an initiating element, a switching arrangement which, in response to a timing signal produced by the timer, is operable to connect the energy source to the initiating element thereby to cause firing of the initiating element, and a circuit which discharges energy from the energy source if the timing signal is not produced by the timer, and wherein the sensing arrangement is responsive to at least one of the following:

(a) a light signal transmitted by a fibre optic cable;
(b) an acoustic signal transmitted by an acoustic transmitter;
(c) a vibratory signal;
(d) a magnetic signal; and
(e) a signal which is electrically transmitted by means of at least one electrical conductor.

BRIEF DESCRIPTION OF THE DRAWINGS

The accompanying

DESCRIPTION OF PREFERRED EMBODIMENTS

Figure 1:
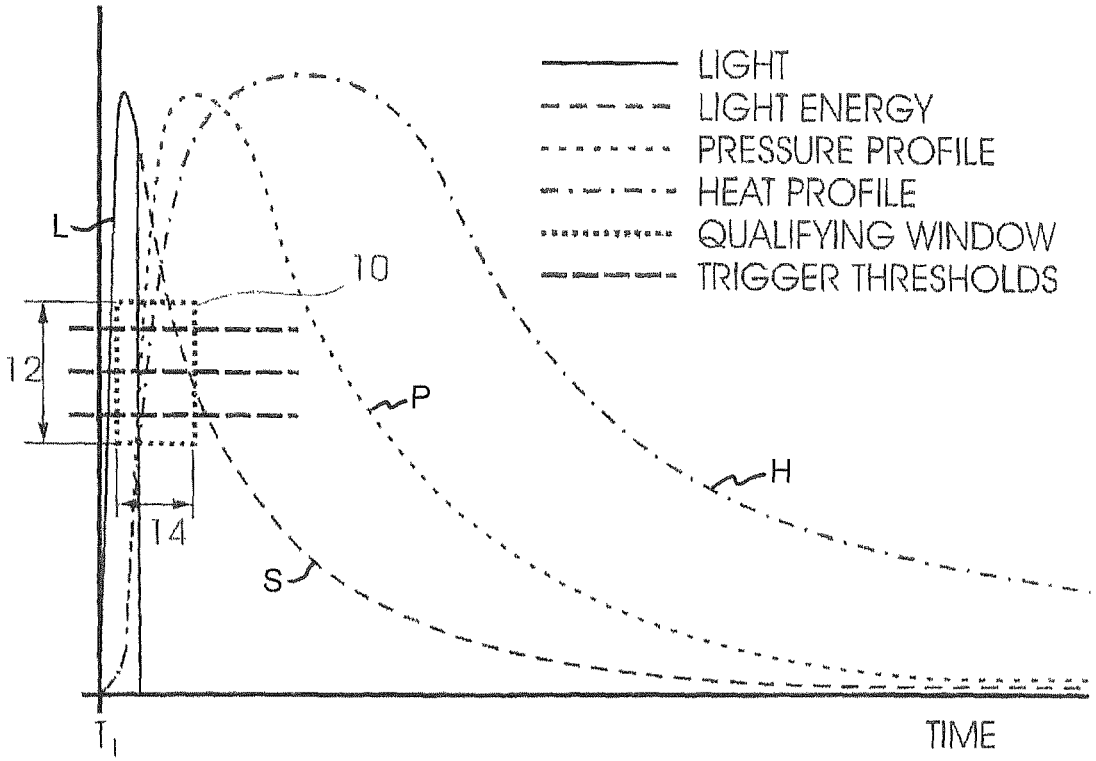
FIGS. 1, 2 and 3 are drawings included in the specification of the parent patent and are reproduced here for ease of reference.
Figure 2:
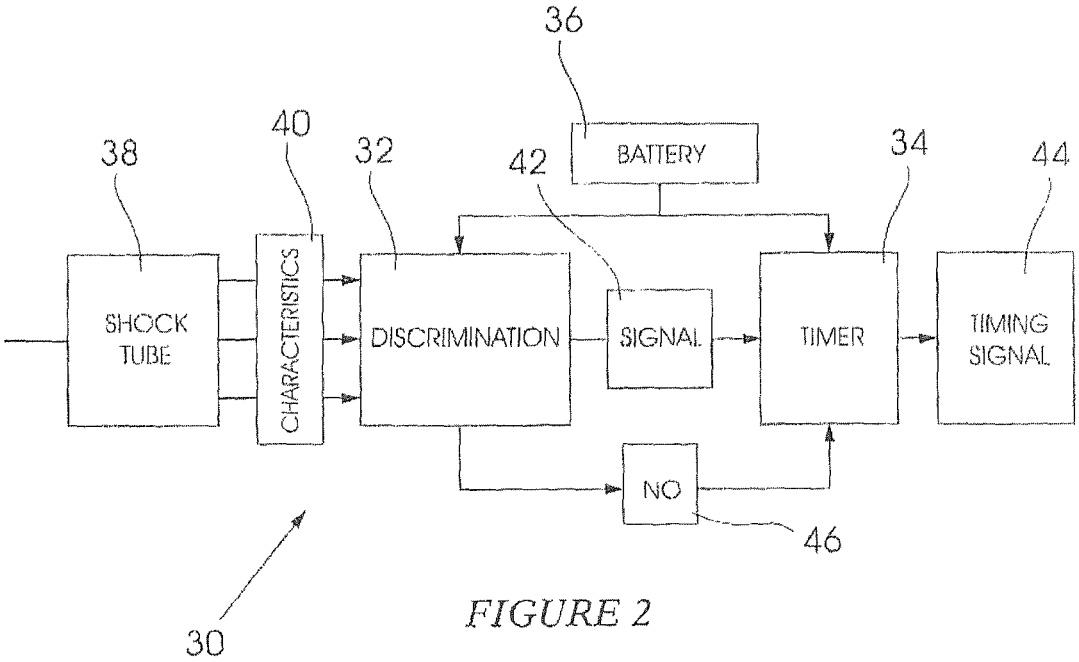
Figure 3:
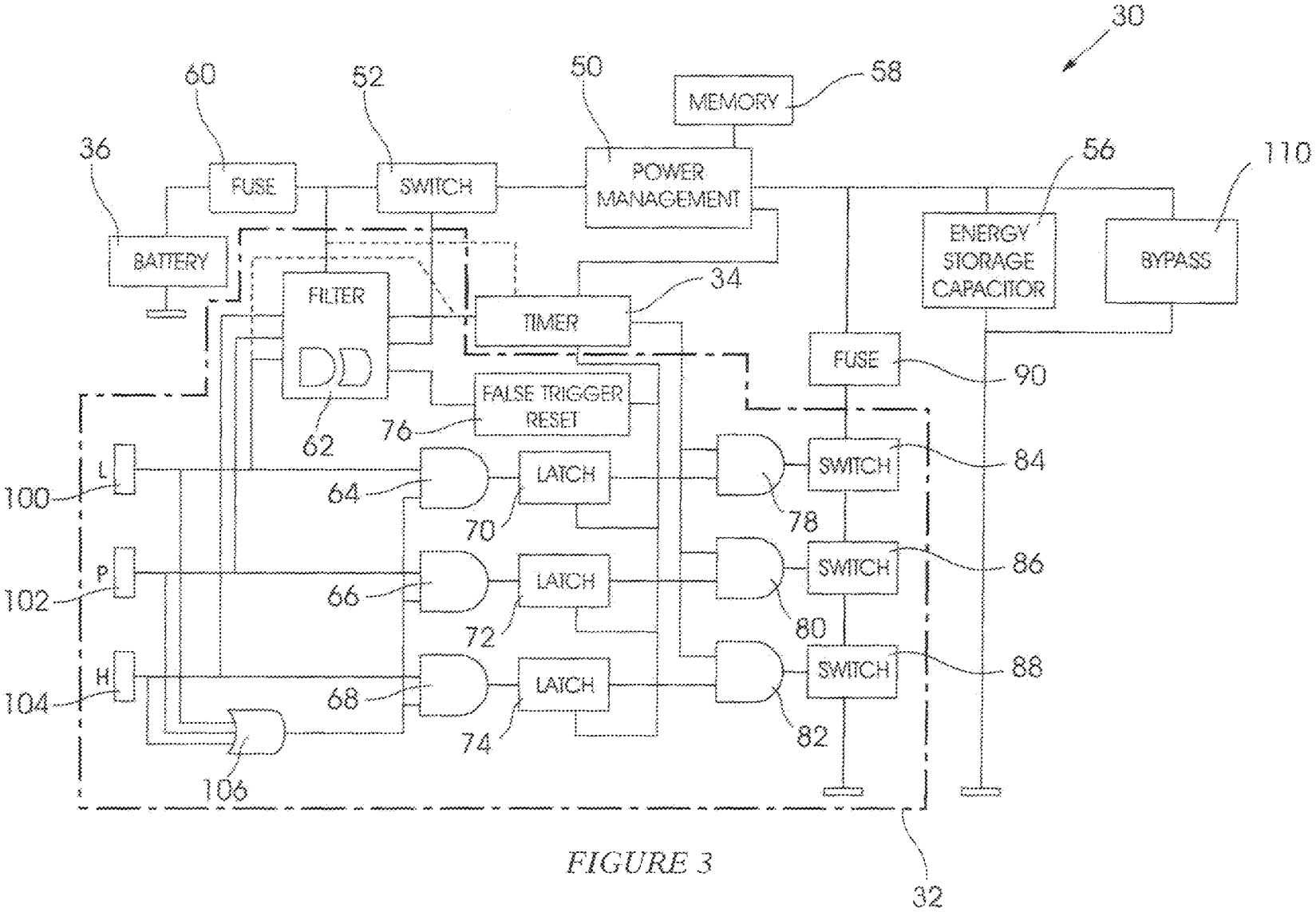

The following description, which relates to FIGS. 1, 2 and 3, is reproduced from the specification of the parent patent for ease of reference and to provide a better background for an understanding of the present invention.

The propagation of a signal by a shock tube, whether by means of a combustion, deflagration, detonation or similar process (referred to herein as a "shock tube event"), produces a number of distinct physical effects (herein "parameters') such as the emission of light, the generation of a pressure wave, and the release of heat. The nature of these parameters, their relative amplitudes, and their interrelationship over time, are determined by the physical composition of the shock tube. It is practically impossible to simulate the specific characters and relationships of the parameters which occur in a shock tube event. The invention is based on the realisation that the unique characteristics of the various parameters which are generated by a shock tube event can be used, subject to carefully controlled validation processes, to control the operation of a timer module, and hence of an electronic detonator, in an effective and safe manner.

FIG. 1 of the accompanying drawings has four normalised curves, labelled L, S, P and H respectively, which illustrate how four parameters, which are generated by a shock tube event, vary as a function of time. These are respectively a light amplitude profile, a light energy profile, a pressure profile and a heat profile. These parameters are delivered in a very short time and some of the parameters occur substantially concurrently. The light energy curve S is notional only. If the amplitude of the light energy is determined at a given time (instant) then the curve would have the same shape as the curve L. If the energy in a light pulse is to be measured over a time interval, then the light amplitude would be integrated over the time interval. The shape of the curve S would then differ from what is shown. As the duration of a light pulse is short there may be benefits in measuring the light energy in a pulse, as opposed to the amplitude only, so that the pulse could be categorised, with a greater level of certainty, as having been produced by a shock tube event.

The amplitude of a light pulse rises from zero to maximum intensity, and then decays rapidly. A temperature rise associated with an advancing ignition front in a shock tube would generally lag the emission of light. The rise time of the temperature pulse would be slower and typically have a profile closer to that of the P and H curves. One possible validation procedure could then be based on the following:

a) detecting the presence of light at least of a predetermined magnitude;
b) detecting the absence of light within a window of defined duration commencing a defined period after successful completion of step (a); and
c) during or after the defined period in step (b), monitoring the rate of change of temperature.

The light amplitude and the rate of temperature change are validated by comparison processes. It is to be noted that, inherently, a further validation is carried out by use of a time window in that measurement of the rate of temperature change would only be effected and taken into account if there is an absence of light during the defined time window.

FIG. 1 illustrates a qualifying window 10 which has an amplitude spread 12 and a time spread 14. The window commences at time T1 after the onset of a shock tube event (time =0) which is taken as the time at which the shock tube event is presented to a timing module (as described hereinafter). Selected parameters which fall within the window are tracked and data pertaining to characteristics of each parameter are stored in a suitable form, analogue or digital, for subsequent retrieval, when required, as reference data. From tests done with representative shock tubes it is possible to record how the chosen parameters and the selected characteristics thereof vary, with respect to time, and the relationships between these characteristics e.g. on a time, amplitude (magnitude), rate of change or other basis. These data are uniquely associated with a shock tube event. The specific natures and relationships of characteristics of parameters such as light, pressure, force, temperature and heat which occur in a shock tube event cannot readily be simulated. Moreover, if required, it is possible to incorporate in the material within a shock tube at least one or more particular elements or compositions ("additives"), which are specifically selected for the purpose, which give rise to one or more additional unique and distinctive characteristics, which may occur within the qualifying window 10 or at some other time. This capability offers substantial benefits from a security viewpoint for it enables the use of the shock tube to be restricted to a timing module, and an associated detonator, with complementary features, and vice versa.

In one respect the characteristics which are to be monitored can be placed into two categories. A first category of characteristics includes those characteristics which are determined substantially instantaneously, for example an absolute magnitude, the presence or absence of a signal, or the rate of change of a characteristic, at a given time. A second category of characteristics includes those which are time-dependent, for example the duration of a signal, the time taken for a signal to appear and then to be absent, and a value which is given by an integral of a time-dependent signal. With the former characteristics, validation procedures can be carried out more rapidly than for characteristics which fall in the second category.

The selected characteristics are categorized as input stimuli which can be electronically detected and processed. The number of stimuli which can be detected could be increased to achieve a commensurate increase in the level of certainty that a genuine shock tube event has been identified. This aspect of the invention is based on the principle that a shock tube event can be positively and accurately identified by characteristics which are uniquely associated with selected parameters produced when a shock tube event is presented at a defined location, and which lend themselves to validation procedures. Incoming data from a tentative shock tube event is subjected to validation processes which are carried out with an exceptional degree of reliability. Upon validation a process of timing a defined time interval is completed. Use is made of electronic means to control the duration of the timing interval for in this way a desired degree of accuracy is achieved.

FIG. 2 is a block diagram representation of certain aspects of a circuit of a timing module 30 according to one form of the invention. The timing module includes a discriminating arrangement 32 which controls the operation of an electrical timer 34. A battery 36 powers the arrangement 32 and the timer 34.

An end of a shock tube 38 is presented to the discriminating arrangement 32. This can be done in any appropriate way. Conveniently the end, not shown, is connected via a suitable coupling to a housing which contains the timing module 30. Use could be made of a single coupling which allows for the detection of parameters which are presented at the end of the shock tube. This is exemplary only and non-limiting. In an alternative arrangement two or more connections are made to a shock tube, preferably near an end of the tube. These connections are spaced apart in an elongate direction of the shock tube. At each connection the shock tube is monitored, using suitable sensors, for the presence or absence of predetermined parameter characteristics. The spacing between the connections lends itself, inherently, to monitoring another characteristic namely the speed of propagation of a wave front (ignition front) in the shock tube. For example at one connection point the magnitude of a light pulse, the rate of change of temperature and the time interval between a maximum light pulse amplitude and a maximum temperature can be detected and measured. These measurements can then be subjected to validation processes. Alternatively, or additionally, the same parameter characteristics are detected and measured at a second connection point which is a known distance from the first connection point. The two sets of parameter characteristics should be identical, except for a time shift which is of known duration. The validation processes are then completed by comparing one set of parameter characteristics to the second set of parameter characteristics. This exercise, which can be carried out in a single validation process or in an additional validation process, enables the speed, and the direction, of propagation of a shock tube event in a shock tube to be verified.

The discriminating arrangement 32 includes a number of sensors (described hereinafter) which monitor parameters of a shock tube event to sense characteristics 40 thereof. If one characteristic is detected and positively identified or validated a signal 42 is produced. The timer is caused to start a timing cycle upon detection of the characteristic.

During the execution of the timing cycle further characteristics presented by parameters of the shock tube event to the discriminating arrangement are detected and validated. If all the inputs to the discriminating arrangement are validated then the timer is allowed to complete its timing cycle and at the end thereof a timing output signal 44 is generated.

In the preceding example the timing cycle is started upon detection of the light signal. The amplitude of the light signal, and the rate of temperature change, are then validated. Alternatively the commencement of the timing cycle takes place only if these two characteristics are validated. In each instance the timing cycle is only completed if, at the second connection, substantially identical signals for the light amplitude and the rate of temperature change are measured.

If the characteristics are not validated or if validation does not take place within a period which is less than the duration of the timing interval or cycle, a signal 46 is sent to the timer to stop its operation. The timing output signal 44 is then not generated, and execution of the timing interval is terminated. Hence the timer is only permitted to continue with the execution of the timing cycle if the signal 42 is produced. If the signal is not produced, i.e. if no validation takes place within a predetermined time interval, the execution of the complete timing cycle is stopped. In another implementation the timer commences execution of the timing cycle only when the signal 42 is produced.

In one particularly preferred embodiment a single sensor, such as a photodiode, is used to monitor two parameters of one shock tube event. For example light, preferably light amplitude, and temperature (the magnitude of the temperature) may be monitored by the use of the photodiode which is biased through the use of an appropriate circuit in a first way so that it is responsive to a light signal and thereafter is biased in a second way so that it is responsive to temperature.

The timing output signal can be used, in a surface harness in a blasting system, to propagate a delay along the harness. Alternatively, as is further described herein, the timing output signal is used to control the firing of an initiating element in a detonator which has been placed in a borehole.

FIG. 3 illustrates additional aspects of the timing module. The discriminating arrangement 32 is enclosed in a dotted line. Connected to the discriminating arrangement is a processor 50 which includes a power management circuit and, optionally, a communication unit (as is hereinafter described), a switching arrangement 52, an energy storage capacitor 56 and a memory 58. The battery 36 is connected to the discriminating arrangement 32 via a fuse 60. The discriminating arrangement 32 includes a digital filter 62, three AND gates 64, 66 and 68 respectively, latching circuits 70, 72 and 74, a trigger reset unit 76, AND gates 78, 80 and 82, switches 84, 86 and 88 respectively which are connected to outputs of the AND gates 78 to 82, and an initiating device 90 which is of any appropriate kind and which is connected in series with the switches 84 to 88.

Three sensors 100 to 104 are respectively connected to the AND gates 64 to 68 and have inputs connected to an OR gate 106. Inputs also go to the filter 62.

Appropriate data are stored in the memory 58 which is connected to the power management circuit 50. These data, typically, include identity data pertaining to, or otherwise associated with, a detonator with which the timing module 30 is to be used, such as timing data, detonator trigger parameters, detonator manufacturing and tracking information, a detonator identifier which is uniquely associated with the detonator, and the like. This list is exemplary only and is non-limiting.

The timing module 30 also includes a communication unit which may be embodied in the processor 50. The communication unit allows communication to take place between control apparatus such as a blast controller (not shown) and the remainder of the power management circuit, the programmable timer and the memory. This feature is of value for, via the communication unit, the data in the memory 58 can be varied to suit operational conditions. For example, the timer could be programmed to change the duration of a timing interval which is executed upon successful validation of parameter characteristics, in accordance with program requirements. The use of a detonator can also be rigidly managed, for firing of the detonator could be inhibited in the absence of defined input criteria.

It is possible to have different validation processes which are carried out in respect of a shock tube event. Each validation process is structured to be as reliable and accurate as any other validation process. Merely by way of example one validation process could be in respect of light amplitude and rate of temperature change while another validation process could be based on the duration of a light pulse and the time interval between a maximum amplitude of a light pulse and a maximum temperature. The communication unit could be employed to ensure that a chosen validation process is implemented. In a blasting arrangement based on the use of a plurality of detonators data pertaining to each validation exercise could be transferred to the memory of each detonator under field conditions using the respective communication units. Prior to this exercise, which is similar to a preliminary arming process, it would not be possible, irrespective of the validation process which is carried out, for a detonator to be fired.

Similarly, data from each detonator e.g. data relating to a detonator status, could be transferred by the respective communication unit to a blast programmer, or to a blast controller.

A primary function of the filter 62 is to derive data from incoming characteristics of selected parameters for validation or confirmation purposes, or directly to validate this data. The filter specifications can be configured or determined in respect of any suitable characteristics which uniquely identify a shock tube event, such as a threshold level or rise time of a parameter, the rate of change of a parameter with time, the integrated value of a parameter over a particular time interval, and the presence and duration, or absence, of one or more parameters within a qualifying timing window or within a plurality of qualifying timing windows. In one implementation, characteristics relating to parameters arising from a shock tube event are processed for validation purposes during a first qualifying window and characteristics from the same or different parameters, as desired, are processed for validation during a second qualifying window or a plurality of subsequent qualifying timing windows.

The filter 62 controls the operation of the switching arrangement 52 and of the timer 34. The timer is programmable to execute a chosen time delay period, as is known in the art. At the end of the time delay period the initiating element 90 is ignited in order to fire a detonator, not shown.

The components which are included in the timing module have a low current consumption. This allows the battery in the power supply arrangement to remain connected permanently, at least to the discriminating arrangement. Preferably the battery is connected, additionally, to applicable parts of the remainder of the circuit, for example to the validation arrangement. Depending on the construction of the timer the battery may be connected permanently to the timer and the timer may then be started by application of an appropriate control signal. Alternatively the timer is started by connecting the battery to the timer. The permanent battery connection is feasible, from a safety point of view, because the initiating element 90 can only be ignited by a firing signal which is generated with a high level of certainty under strictly controlled conditions. This factor facilitates, in one respect, manufacture of the timing module for the need for a switching circuit which can connect the battery to the remainder of the circuit, under defined conditions, is eliminated.

The module 30 is coupled to the shock tube 38 in such a way that the sensors 100 to 104 are exposed at least to selected physical processes which result upon signal propagation by the shock tube. Thus the sensor 100 is responsive to light intensity (amplitude) or frequency or, optionally, to both values. The sensor 102 responds to a pressure level i.e. the absolute or relative value of pressure. The sensor 104 is heat-sensitive and is directly responsive to the temperature level or to the quantum of heat which is incident on the sensor. These responses are given by way of examples only and are non-limiting.

It is apparent from the aforegoing that the filter may be used to validate at least some characteristics, directly. Alternatively or additionally a signal from the filter may be subjected to validation by comparing the signal to reference data pertaining to the respective characteristics, stored for example in the memory which could be non-volatile memory.

If any of the sensors produces a positive signal then this is indicative that a preselected characteristic has been detected. The switching arrangement 52 is initiated and the timer 34 is started. Alternatively these events take place only upon validation of a respective signal from the or each sensor. This allows the timer to start its timing interval as close as possible to the onset of the shock tube event. It is possible, though, to allow for an offset time period so that the timer is caused to start a timing interval only after a predetermined delay from the onset of the shock tube event. The use of an offset time period holds benefits in that management and operational functions can be carried out by the management circuit and, only if those functions are satisfactorily completed, is the timing interval thereafter started.

If the timer is wrongly started or if a validation process is unsuccessful or is not correctly implemented then, in response to a subsequent signal 46 output by the filter, the trigger reset unit 76 is actuated so that the timer can be reset.

Assume that the timer 34 commences a timing interval upon detection of a first positive signal from the filter, produced by the sensor 100. If a signal from either of the sensors 102 and 104 is not confirmed as being representative of a characteristic of a shock tube event then the timing process is immediately terminated. If all the signals output by the sensors are verified by the filter then the timer 34 is allowed to execute its full timing period and the latching circuits 70 to 74 are actuated. The switching arrangement 52 is operated at a suitable time, and energy from the battery 36 is transferred by the power management circuit 50 to the capacitor 56 which is thereby charged to a suitable voltage. Preferably, the battery 36 is not capable of igniting the initiating element at least within a different time interval of predetermined duration, for example because the battery voltage is too low or the battery cannot output adequate power.

The charging of the capacitor can take place while the timer 34 is counting its timing period. At the end of that period an output signal from the timer is applied to the AND gates 78 to 82 and the switches 84 to 88 are simultaneously closed. Energy from the capacitor is then discharged through the initiating element 90 which is thereby ignited.

Thus, in combination, the battery 32, the capacitor 56 and the power management circuit 50 make up a power supply arrangement to power operation of the circuits in the detonator and to produce energy at an appropriate level for firing the element 90.

If a fault occurs which prevents ignition of the element 90, for example if simultaneous closure of the switches 84 to 88 does not take place, a bypass circuit 110 is operated by the processor/power management circuit 50 so that the energy, which had previously been stored in the capacitor, is discharged within the aforementioned defined time interval. This energy is thereby safely dissipated and is not available to ignite the initiating element. This is a beneficial feature which allows the effect of a detonator misfire to be effectively and reliably negated. Alternatively or additionally the bypass circuit 110 can be used to discharge the battery fully. Also, the processor/power management circuit can be used to control the functioning of the switching arrangement 52 so that the battery is connected to the fuse 60 in a manner which causes the fuse to melt or blow. The battery is then isolated from the remainder of the circuit.

The sensing and validation functions carried out by the discriminating arrangement 32 can be effected by means of a single circuit (preferably an integrated circuit) constructed for the purpose, or by means of two or more circuits, according to requirement. For example a first circuit could be used to sense and process characteristics of parameters such as light and pressure and a second circuit could be used to sense and process characteristics of parameters such as heat and sound.

In another approach substantially identical circuits are operated in parallel. Each circuit senses and executes validation processes on the same set of characteristics. Through the use of appropriate logic circuitry the initiating element 90 is only ignited if the circuits produce substantially identical outputs. Redundancy arrangements of this kind enhance the inherent reliability and safety of the timing module.

In contrast to the characteristics of the detonator described herein with reference to FIGS. 1, 2 and 3, the current invention provides a detonator which is not responsive to a shock tube event but instead is responsive to a trigger event which can be selected from various different stimuli.

Figure 4:
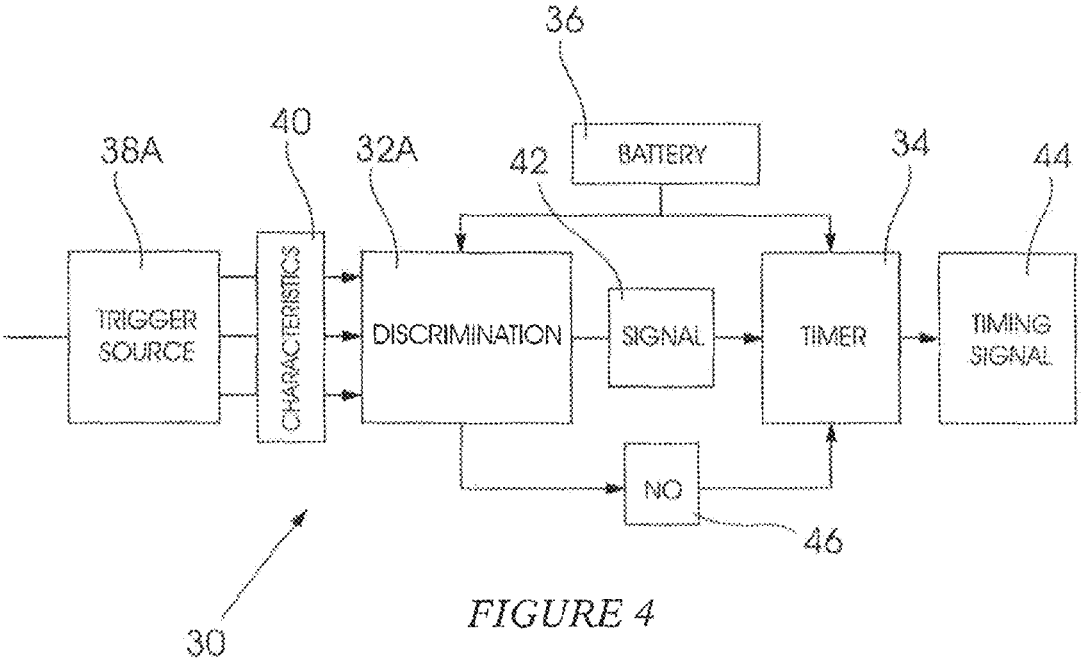
FIGS. 4, 5 and 6 depict aspects of the current invention.

FIG. 4 bears significant similarities to FIG. 2 and for this reason only the differences between these two circuits are described. In FIG. 4 the end of the shock tube 38 of FIG. 2 is replaced by a trigger source 38A. The trigger source, when activated, presents characteristics 40 to a discriminating arrangement 32A which is specifically designed taking into account the nature of the trigger source. As is the case when a shock tube event is sensed, if one characteristic (coming from the trigger source 38A) is detected and positively identified or validated, a signal 42 is produced and the timer 34 is caused to start a timing cycle thereupon.

During the execution of the timing cycle further features presented by the trigger source to the discriminating arrangement 32A are detected and validated. If all is positive then the timer 34 is allowed to complete its timing circle and at the end thereof a timing output signal 44 is generated.

Figure 5:
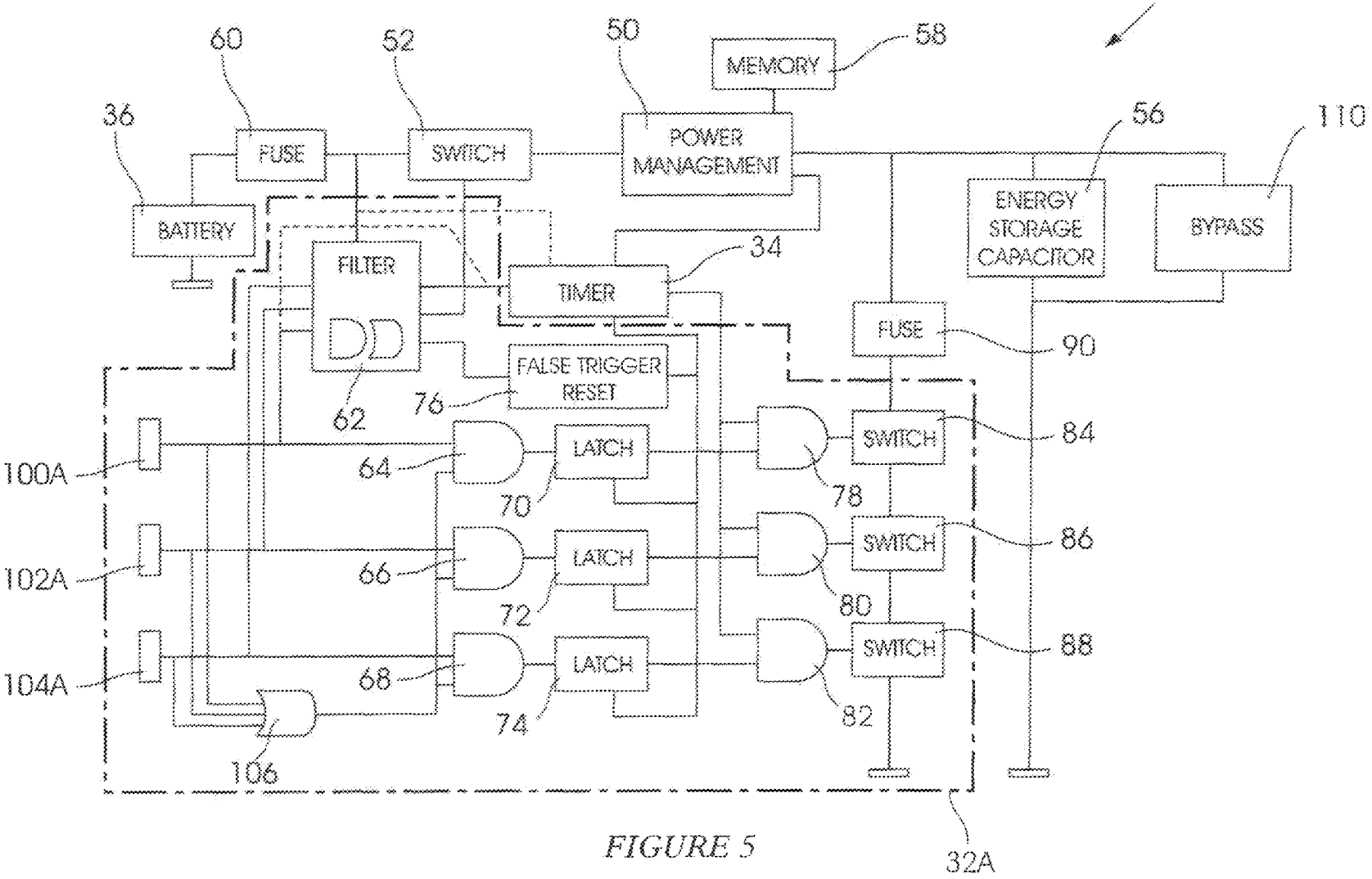

FIG. 5 shows a modified form of the arrangement shown in FIG. 3. At least one sensor 100A, but preferably multiple sensors 100A, 102A and 104A, are used to detect specified features or characteristics of a signal generated by the trigger source 38A. Clearly the arrangement in FIG. 5 is simplified if only a single sensor 100A is employed.

The filter 62 is again used generally in the manner which has been described in that its function is to derive from incoming characteristics 40 (FIG. 4), features of a signal presented to the discriminating arrangement by the trigger source 38A (FIG. 4).

Figure 6:
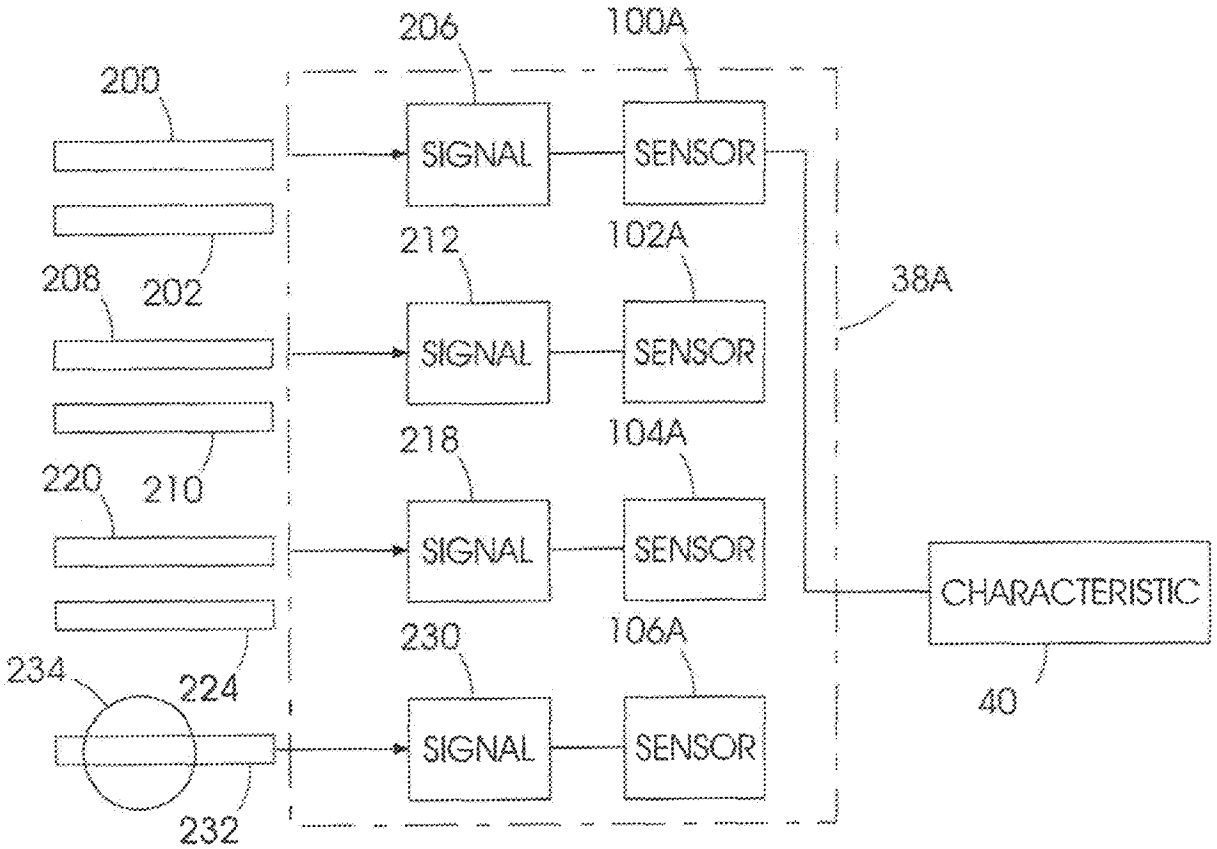

FIG. 6 includes a number of drawings which respectively show different possible forms of the trigger source 38A. In general terms the current invention envisages the use of any appropriate trigger source which can reliably be used to transmit a distinct signal which can be validated by suitable circuitry associated with a detonator and which thereupon can initiate a firing process of the detonator. The different trigger sources which are illustrated could be used in isolation or in combination. It is also possible to use any of the trigger sources referred to in connection with FIG. 6 in conjunction with a shock tube event as has been described in the specification of the parent patent.

Depending on factors such as cost, reliability and redundancy the trigger source could include two or more input arrangements which could be of the same or different kinds, operated in parallel.

FIG. 6 illustrates, according to one aspect of the invention, two fibre optic cables 200 and 202 which are operated in parallel and which are used to transmit a light signal 206 to a sensing arrangement 100A. Each cable could be associated with a respective sensor or, as appropriate, one sensor can be used with both cables 200 and 202.

The fibre optic cable 200 transmits to the sensor 100A a light signal 206 at a distinct and tightly controlled frequency. The signal 206 may be encoded i.e. it may be pulsed. The fibre optic cable 202 can work in a similar manner. It could transfer a signal identical to that in the cable 200 or a signal which differs in frequency or in pulse form therefrom. The signals from the fibre optic cables, detected by the sensor 100A could be matched to one another using criteria previously established. Alternatively the signals could be validated by comparing data from the signals to pre-determined data previously selected and stored in the memory 58.

For example if the signals are matched to each other one could rely on an alternating pulse sequence between the signals, on a fixed or variable time difference between the signals, or the like. Different possibilities present themselves in this regard.

In an alternative form of the trigger source 38A, acoustic tubes 208 and 210 are used to present one or more acoustic signals 212 to a suitable transducer 102A. The signals relayed by the tubes 208 and 210 could be interrelated in that one signal is dependent on the other, e.g. the signals could be pulsed in an alternating sequence or their frequencies could vary in a pre-determinable manner, or a different interdependent type of relationship could be established. The transducer 102A, which could be one of a number of similar transducers, is used to detect the acoustic waves emitted by the tubes and to establish whether one or more pre-determined interrelated factors are present.

In a third form of the invention, which is closely related to the acoustic form, vibratory or shock signals 218 are presented to a sensor 104A via appropriate pickup mechanisms 220 and 224. Vibratory signals, particularly at a low frequency, can be transmitted through the ground (for example) over a substantial distance. Depending on the manner in which the vibratory signals are generated and the degree of control exercised over the generation of the signals the sensor 104A can reliably detect one or more actuating vibratory signals and, if the signals are validated, preferably using redundancy techniques or relationships which are interdependent e.g. one frequency is a function of a second frequency or one pulse train is dependent on another pulse train, similar to that referred to in connection with the light signals and the acoustic signals, a reliable determination can be made as to whether detected vibratory signals are to be used for initiation of the detonator.

Alternatively or additionally it is possible to make use of a sensor 106A or a number of sensors (not shown) to detect an incoming electrical signal 230 which is transmitted on a conductor 232, or a magnetic signal (a magnetic field) 234 transmitted via the conductor 232, or transmitted and received using magnetic field transmission techniques known in the art. It is possible to make use of a number of the conductors 232 to achieve redundancy and to enhance security. One or more electrical signals 230 could be pulsed or encoded. If analogue signals are used then these could have specified frequencies or phase differences. A similar consideration applies to the use of one or more magnetic fields as a trigger source.

In each instance characteristics 40 of the detected signal or signals are applied to a suitable discriminator 32A for verification and validation purposes. The function of the power management circuit is unaltered from what has been described and offers the same degree of safety/isolation in that electrical energy is transferred to the capacitor 56 at a voltage which can be used to fire the detonator i.e. the fuse 90. The transferred voltage is higher in value that the voltage of the battery 36. The latter voltage is of course too low to fire the detonator.

What is claimed is:

1. A detonator which includes a sensing arrangement, a timer which is operable to complete execution of a timing interval of a predetermined duration in response to the sensing arrangement, an energy source, an initiating element, a switching arrangement which, in response to a timing signal produced by the timer, is operable to connect the energy source to the initiating element thereby to cause firing of the initiating element, and a circuit which discharges energy from the energy source if the timing signal is not produced by the timer, and wherein the sensing arrangement is responsive to at least one of the following:

(a) a light signal transmitted by a fibre optic cable;

(b) an acoustic signal transmitted by an acoustic transmitter;

(c) a vibratory signal;

(d) a magnetic signal; and (e) a signal which is electrically transmitted by means of at least one electrical conductor.

2. A detonator according to claim 1 wherein the timer is programmable, and further comprising a communication unit which can communicate with an external controller and thereby vary said predetermined duration of the timing interval.

3. A detonator according to claim 1 which includes a communication unit which can communicate with an external controller.

4. A detonator according to claim 3 wherein the timer is programmable, and further comprising a communication unit which can communicate with an external controller and thereby vary said predetermined duration of the timing interval.

5. A detonator according to claim 1 which further includes a memory in which data, selected from the following, is stored: timing data, detonator trigger parameters, detonator manufacturing and tracking information, detonator identification data.

* * * * *